US005787637A

United States Patent [19]

Keen

[11] Patent Number: 5,787,637

[45] Date of Patent: Aug. 4, 1998

[54] PAVING SYSTEM

[76] Inventor: David P. Keen, 3317 McGregor Moor, Birmingham, Ala. 35242

[21] Appl. No.: 192,510

[22] Filed: Oct. 6, 1994

Related U.S. Application Data

[63] Continuation of Ser. No. 805,585, Dec. 11, 1991, abandoned.

[51] Int. Cl.[6] ..... A01G 17/00

[52] U.S. Cl. ..... 47/25

[58] Field of Search ..... 47/23, 25, 31, 47/30, 26; 404/31, 29

[56] References Cited

U.S. PATENT DOCUMENTS

| | | | |
|---|---|---|---|
| 1,275,165 | 8/1918 | Hassam | 404/29 |
| 4,308,688 | 1/1982 | Revane | 47/25 |
| 4,986,025 | 1/1991 | Imperial | 47/25 X |

FOREIGN PATENT DOCUMENTS

| | | | |
|---|---|---|---|
| 2665821 | 2/1992 | France | 47/25 R |
| 2668029 | 4/1992 | France | 47/25 R |
| 3534437 | 4/1987 | Germany | 47/25 |
| 3717952 | 12/1988 | Germany | 47/25 R |
| 674034 | 4/1990 | Switzerland | 47/25 |
| 2202722 | 10/1988 | United Kingdom | 47/23 |

*Primary Examiner*—Michael Safavi
*Attorney, Agent, or Firm*—Thad G. Long

[57] ABSTRACT

A paving system comprising a support frame, porous material above the support frame and pavers above the porous material, suitable in certain configurations to have mirror image support frames suspendable at their inner points from the outer periphery, and fitting about a tree or other object.

10 Claims, 10 Drawing Sheets

PAVING SYSTEM

BRIEF SUMMARY OF THE INVENTION

This application is a Continuation of U.S. Ser. No. 07/805,585, filed Dec. 11, 1991, and entitled "Paving Support Structure", which is or will be copending and is to be abandoned upon the attachment hereto of the rights accorded continuations.

Trees planted in an area of pedestrian travel have long posed several problems associated with the surrounding walking surface. The root ball of the tree must be protected from damage, while permitting air, water and nutrients ready accessibility to the tree roots. The area around the tree and its roots must be accessible for fertilization and cleaning on a continual basis, and for treatment if the tree should become injured or sick. The area above the root ball should be easy to keep clean from litter, should discourage growth of weeds and should pose few problems for pedestrians to travel across. When necessary the materials forming the walking surface and its underlying support structure should be easily removable for direct access to the roots and surrounding soil and other subsurface materials.

However, there have been problems in dealing with trees planted in a pedestrian environment. Grates of cast iron, plastic or other such materials have been used to cover and protect the root ball of the tree, but their inherent openness collects trash, allows weed growth and impedes traversal, especially by the physically impaired and especially those who may be using walkers or canes, and also those wearing narrow heeled shoes. The grates furthermore do not necessarily compliment the surrounding surface material and may be especially heavy, making it nearly impossible for a single individual to install or remove the grates. Moreover, because of their weight, cast iron grates are expensive to ship great distances from the foundry. In addition, the plastic types may become brittle and subject to deterioration from the elements, while the cast iron types rust, sometimes staining the surrounding surface.

Precast pavers, bricks, and other such units have been placed over tree root balls in the past. They are usually laid loose over a smooth sand bed and tamped flush to surrounding grade. Over time, weeds may sprout between the units; the base and root ball may settle, causing unevenness in the walking surface; or the tree bole expands dislodging the units and causing unevenness in the walking surface.

Trees planted in pedestrian areas have also been surrounded with nothing, leaving the area open. This approach allows free growth of weeds, collection of trash, and compaction of the root ball of the tree (which may inhibit growth or cause the death of the tree), and results in a very uneven surface for pedestrians to traverse.

It is the object of the present invention to provide a structure over which a selected surface material may be placed to surround a tree planted in a pedestrian situation which can: (1) be constructed from a limited number of structural components and struts for economical assembly-line fabrication or construction; (2) support a selected surface material, such as pavers, over the tree root ball to match surrounding materials in height and ease of traversal; (3) suspend the selected surface material above the tree root ball creating an open area that allows air, fertilizer, water and nutrients to penetrate to the tree roots; (4) allow sufficient space between the selected surface material and the top of the tree root ball for future growth and expansion by the tree; (5) discourage weed growth by limiting the availability of areas conducive for weeds; (6) reduce crevices, holes, and other "catch areas" for the accumulation of trash and other debris; (7) allow for ease of access to the tree root ball area should such access be deemed necessary; (8) allow for ease of installation and removal by a single individual by limiting the weight of the individual components necessary for construction; (9) allow the ready removal and replacement of the selected surface material as necessary for repair or replacement or to achieve a modification of the original or existing design; (10) expand the area of comfortable, safe pedestrian travel; (11) be shipped in larger quantity and greater distance from the manufacturer at an attractive price because of its weight; (12) be obscured from view by the placement of the selected surface material over the invention, also obscuring from view any staining or discoloration as may happen from rust, oxidation, and other sources; (13) be adapted so that it will be useful and compatible with various types of surrounding spaces, surface materials and configurations which may be encountered in different design applications; and (14) be installed in both new and existing surroundings.

Described below, as illustrated by the accompanying drawings, are preferred embodiments of the invention.

DETAILED DESCRIPTION OF THE DRAWINGS

Figure 1:
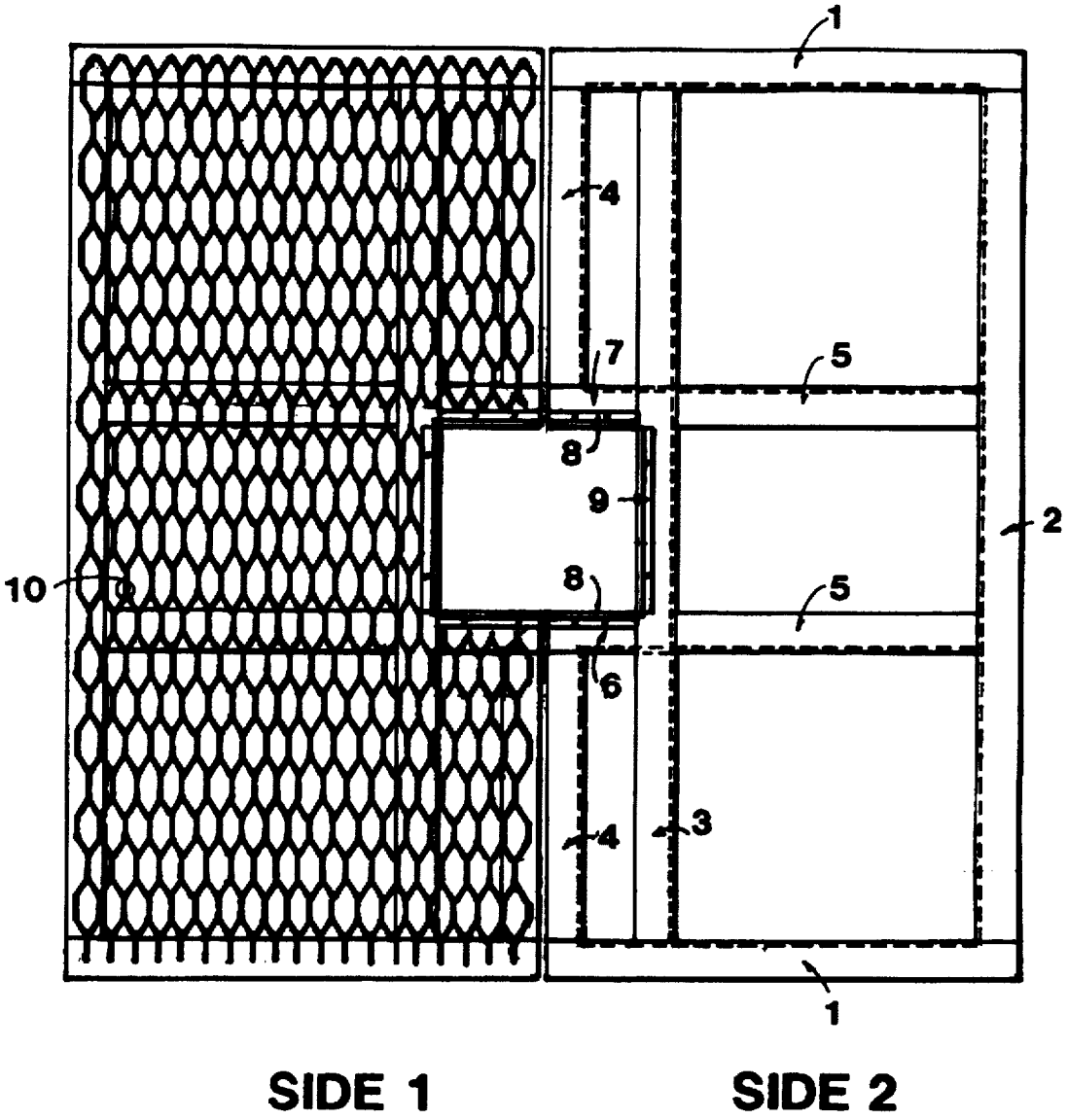
FIG. 1 is an overhead view of one of the basic configurations of a preferred embodiment of the support structure with which the invention is concerned. Side 1 is a fully assembled view of the support structure. Side 2 has the upper portion of the support structure removed to view the bracing beneath.

FIG. 1 is an overhead view of one of the basic configurations of the invention. The complete invention as shown in this embodiment is composed of two identical sides—sides 1 and side 2. In FIG. 1, Side 1 is overlaid with the chosen support material 10, such as expanded metal attached to the base framework. Side 2 has been illustrated without the support material 10, to allow viewing of one of the basic configurations of the support frame used to hold support material 10 in a flat plane to allow placement of a chosen cover material such as pavers or pavement. Support frame pieces 1 through 7 are joined together where they intersect each other, as shown, to prevent any sagging of the frame which could cause the chosen support material 10 to not rest in a proper flat plane position. Support frame pieces 8 and 9 are attached to support frame pieces 3, 6 and 7 in such a manner to allow their adjustment up to the sides of the chosen cover material (pavers and other types of pavement), which rests on the chosen support material 10 to keep it from any lateral movement, once installed.

Figure 1A:
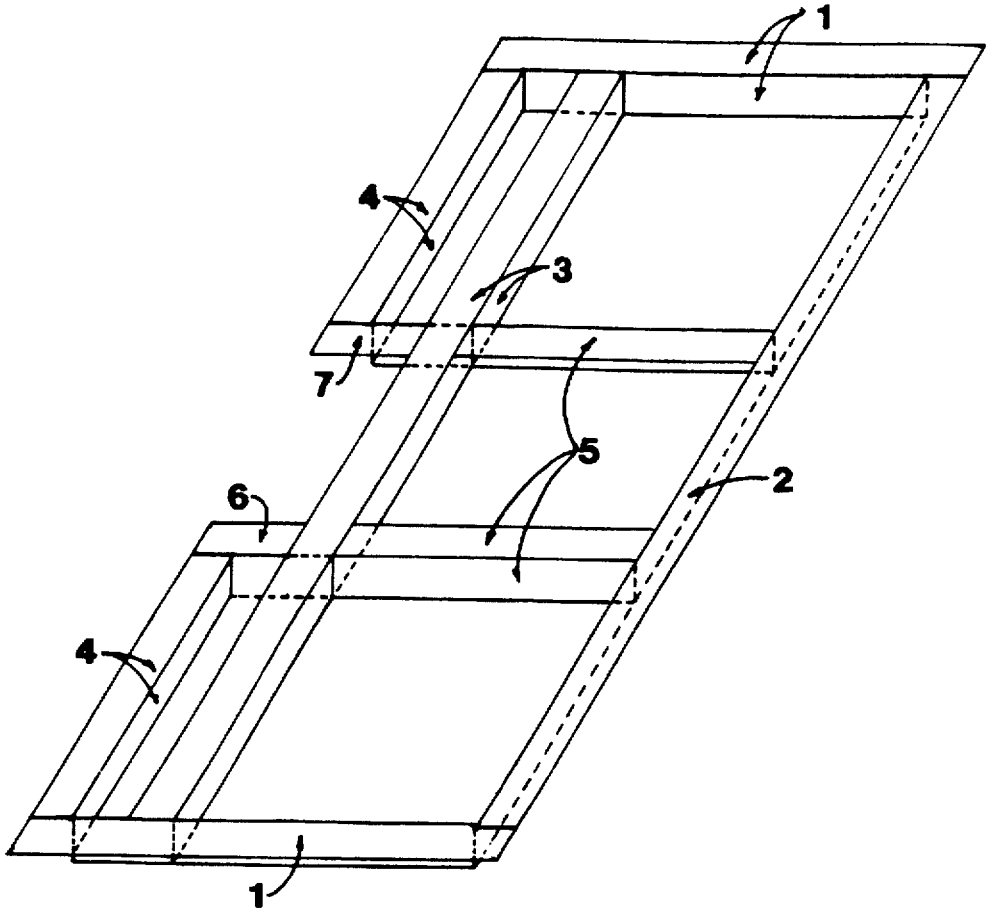
FIG. 1A is a perspective view of a side 2 from FIG. 1.

FIG. 1A is perspective view of Side 2 from FIG. 1 showing parallel structural components 2, 3 and 4 (two pieces), joined with substantially perpendicular components 1 (two outer pieces), 5 (two inner pieces) and 6 and 7. As shown, components 5 and 7, and 5 and 6, are in line, broken by unitary structural component 3. However, it is clear that the same result could be achieved by breaking component 3 into three segments joined by unitary components 5/7 and 5/6. Similarly, component 2, parallel with component 3, could also be broken into three segments joined by somewhat longer unitary components 5/7 and 5/6. It will often be convenient to use parallelepiped-shaped hollow structural components or L-shaped structural components, made of a durable metal, but any rigid material of sufficient strength and durability will function satisfactorily. It will normally be desirable for the upward-facing surface of the structural component to be flat and continuous over its extent in order to provide a secure surface over which to place the chosen support material, but this is not essential as long as a single plane is formed by the upper-most portions of the structural components. If sufficient strength of the structural components has otherwise been secured to support the designed-for weight loads, the structural components need not be continuous on any of their surfaces, and in the case of a parallelepiped structural component, one or more (but less than all) of the four potential sides can be omitted altogether (the L-shaped piece being a special case where two adjacent sides have been omitted).

Figure 2:
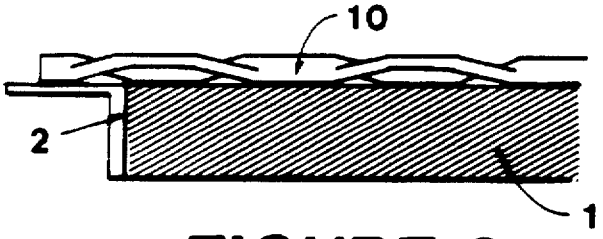
FIG. 2 is a cross section showing two of the basic support braces on top of which the material support structure has been placed.

FIG. 2 is a cross section showing the intersection of base support members 1 and 2 supporting the chosen support material 10 attached to them.

Figure 2A:
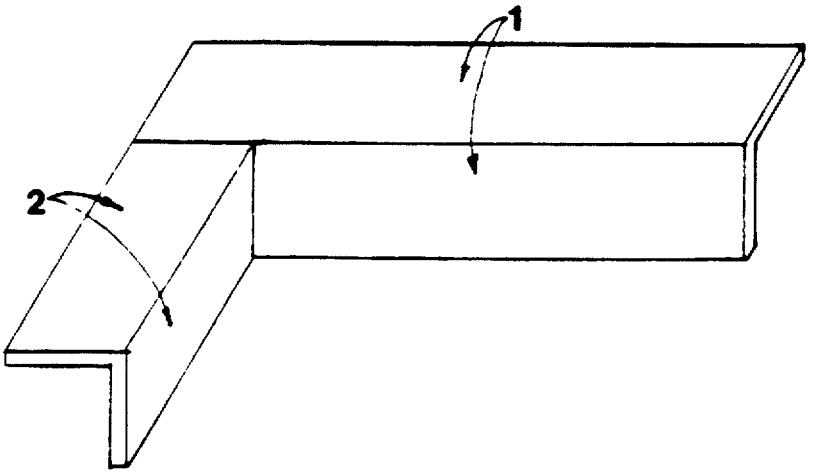
FIG. 2A is a perspective view of FIG. 2, without the support material on top.

FIG. 2A is a typical ninety-degree joint at the position where structural component 1 joins structural component 2. Joints at other locations would be similar.

Figure 3:
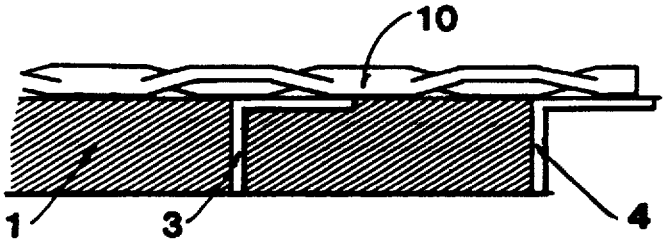
FIG. 3 is a cross section showing two of the basic support components on top of which the material support structure has been placed.

FIG. 3 is a cross section showing the intersection of base support members 1, 3, and 4 supporting the chosen support material 10, attached to them.

Figure 4:
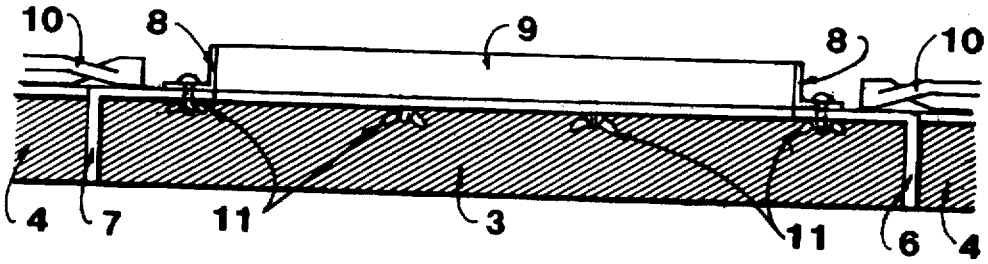
FIG. 4 is a cross section of four of the basic support components on either side of which the material support structure has been placed. The figure also shows a basic configuration of two components attached to the basic support components by wing nut and bolt 11 used to limit the movements of the chosen cover material over the structure and to keep the center area open around the tree trunk.

FIG. 4 is a cross section showing the intersection of base support members 3, 4, 6 and 7 supporting the chosen support material 10 attached to them. FIG. 4 also shows one of the basic attachments of support frame members 8 and 9 attached to frame members 3, 6 and 7 in such a manner as to allow for adjustment of support frame members 8 and 9 to give lateral support for the chosen cover material.

Figure 4A:
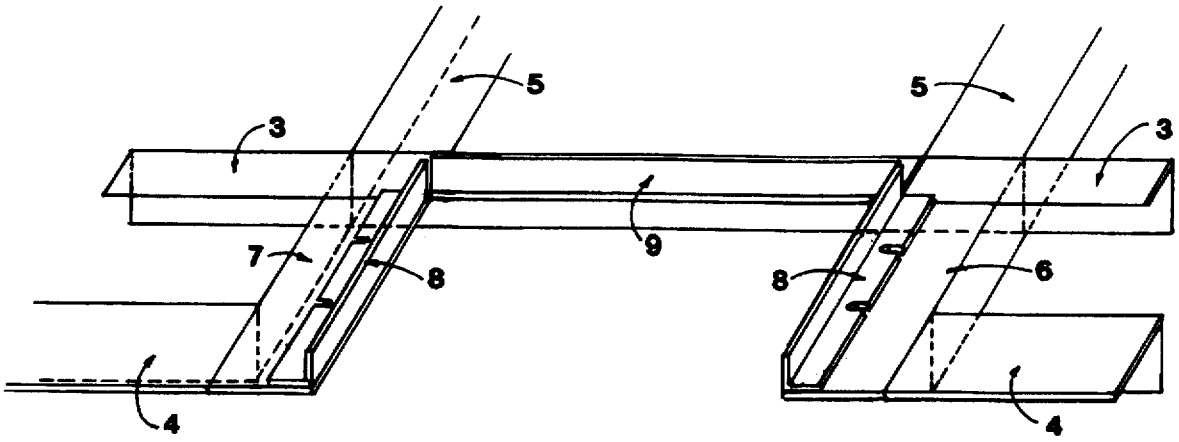
FIG. 4A is a perspective view of FIG. 4, without any support material on top.

FIG. 4A is simply a perspective view of FIG. 4, without any support material 10 and without any fastening or attachment means shown, but showing holes in support frame members 8, which could be used for screws, pins or other fastening means.

Figure 5:
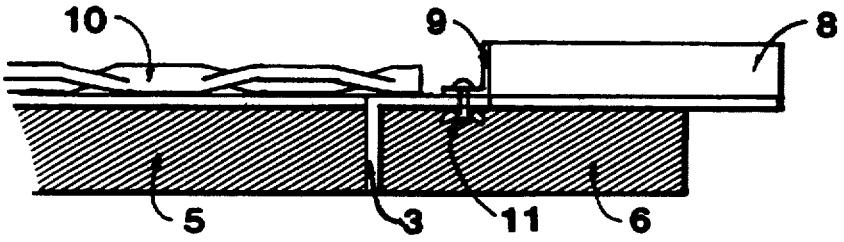
FIG. 5 shows a side view of FIG. 4.

FIG. 5 is a side view cross section of FIG. 4 showing support frame members 3, 5 and 6, support material 10 attached to them and support frame members 8 and 9 attached to frame member 3 and 6 as described in FIG. 4.

Figure 6:
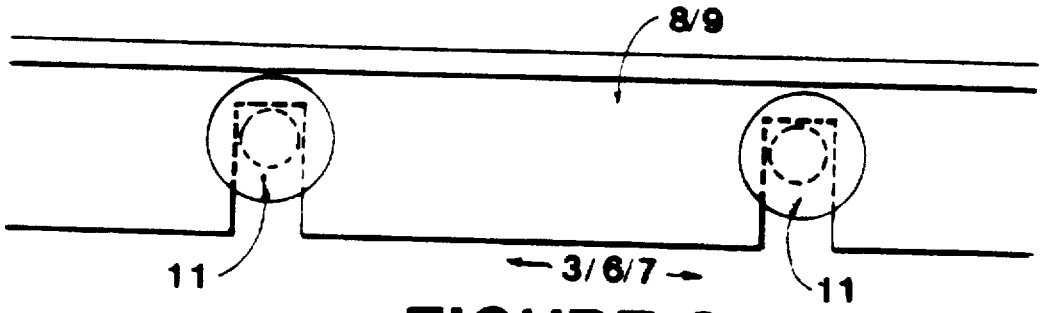
FIG. 6 shows an overhead view of the bracing used to limit the movement of the chosen material and one possible means of its attachment to the support structure bracing through use of wing nut and bolt 11.

FIG. 6 is an overhead view of one of the possible ways for base frame support pieces 8 and 9 to be attached to frame pieces 3, 6, or 7 to allow their lateral adjustments as described in FIG. 4.

Figure 7:
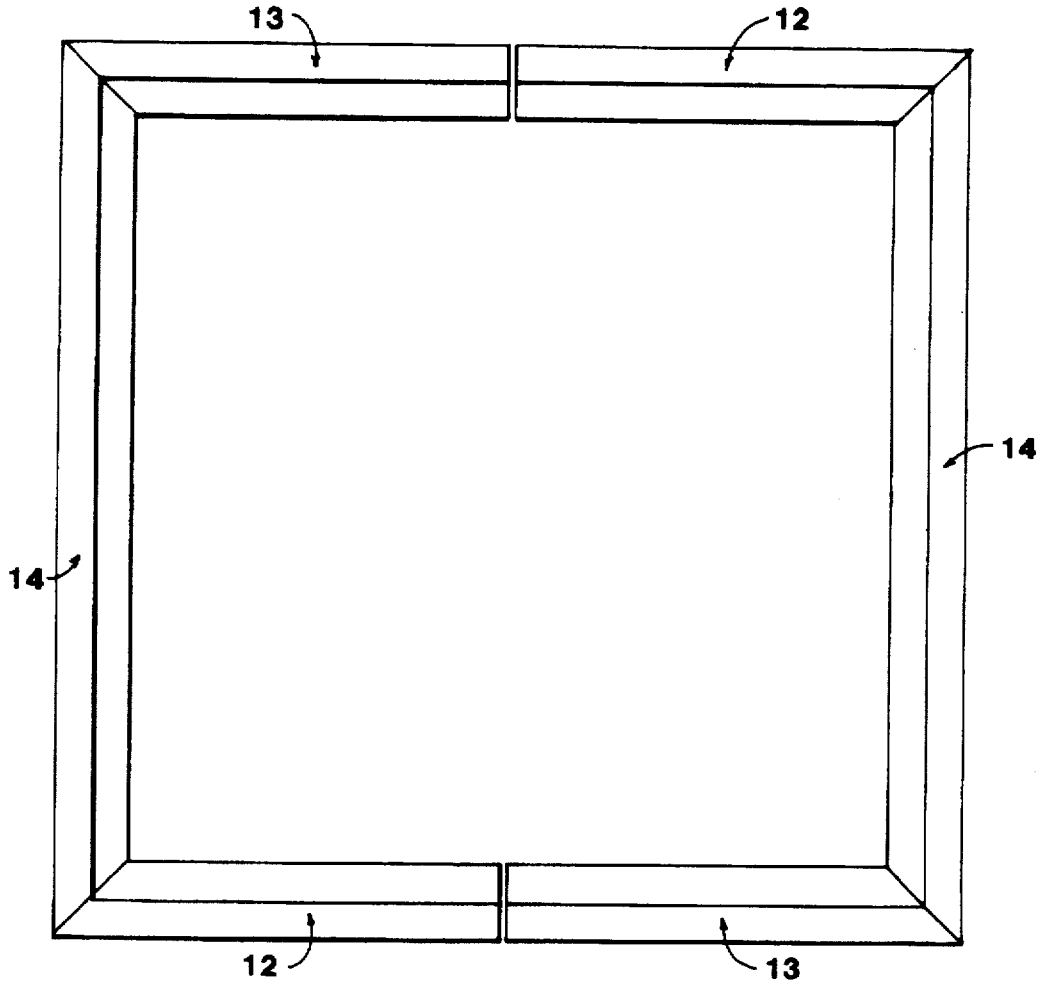
FIG. 7 is an overhead of one of the basic configurations of an additional support bracing system when installing the invention in an area where the surrounding paving has been saw-cut for installation of a tree.

FIG. 7 is an overhead view of one of the basic configurations of an additional support frame 12, 13 and 14 when used to support the invention in an existing area where pavement surrounding the invention has been saw-cut to allow placement of a tree. The two identical sides are placed in the tree pit and supported on all four sides by the saw-cut paving. Once in place the base configuration of the framework, two pieces of side 1 as shown in FIG. 1, is placed inside it in such a way that in the areas where the two pieces are put together their joint is on solid frame member 14.

Figure 8:
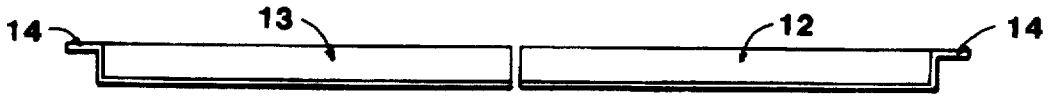
FIG. 8 is a cross section of FIG. 7.

FIG. 8 is a cross section of FIG. 7 showing one of the basic configurations of additional support frame members 12, 13 and 14.

Figure 9:
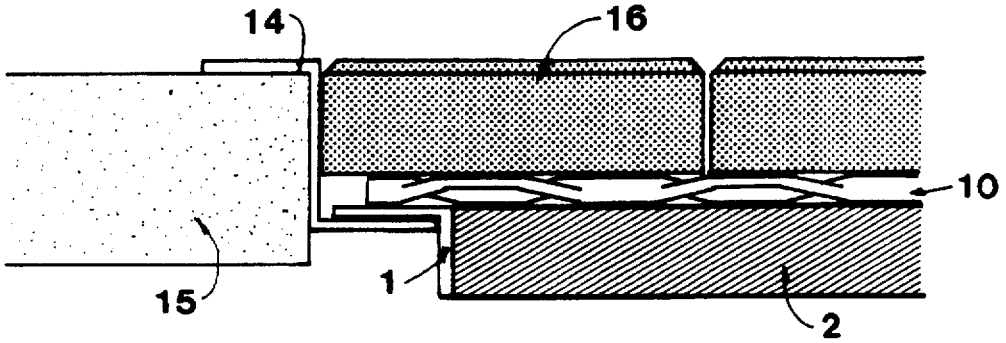
FIG. 9 a cross section of one of the basic configurations, has been used in conjunction with the additional support bracing system in a tree pit that has been saw-cut into existing paving. The chosen cover material is shown in place over the basic support system.

FIG. 9 is a cross section showing one of the basic support frames 1, 2 and 10, the chosen support material, all of which is suspended from a saw-cut section of paving by means of rigid suspension means 14. Across the top of support material 10 has been placed paving material 16 which is at substantially the same level as the saw-cut paving material 15 and other contiguous paving material and relatively continuous walking surface.

Figure 10:
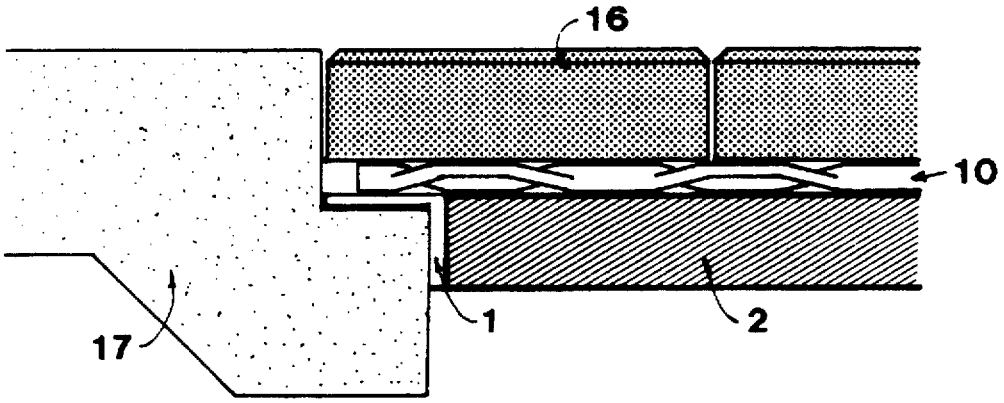
FIG. 10 is a cross section showing one of the basic support systems with the chosen cover material in place when installed in new paving construction. The support system rests on a ledge created during the new paving construction.

FIG. 10 is one of the basic configurations of the support frame 1, 2 and 10, the chosen support material, when being installed during new paving construction. Frame rigid suspension means 1 and 2 are resting on new paving material 17, with chosen support material 10 being attached to 1 and 2. The chosen paving material 16 has been installed over the framework.

Figure 11:
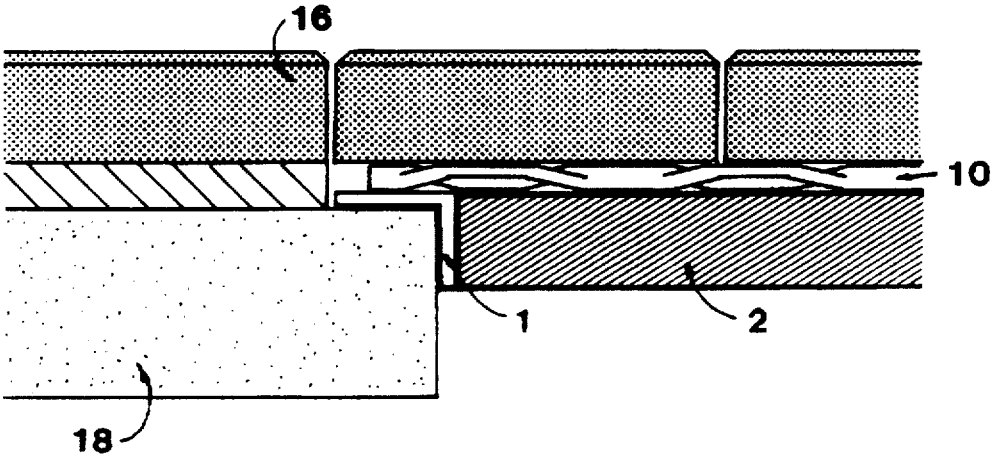
FIG. 11 is a cross section of one of the basic configurations of the support system when used in an area of new construction. The basic support system is supported on a ledge created during construction and the chosen cover material matches the surrounding paving material.

FIG. 11 is a cross section of frame members 1 and 2, the chosen support material 10 attached to 1 and 2, and the invention being placed in new paving material 18 in such a manner that the chosen paving material 16, installed above the chosen support material 10, matches the surrounding grades and paving material in connection with which it is being installed.

What is claimed is:

1. A three-layered paving system comprising:

(a) a support frame of rigid elongated members joined together to define a plane about the uppermost portions thereof;

(b) a rigid mesh-type material to form a layer above said support frame; and (c) pavers placed above said rigid mesh-type material.

2. A paving system as described in claim 1, wherein said support frame has rigid suspension means at points along its outer periphery.

3. A paving system as described in claim 1, wherein an inner portion thereof is configured to allow for fitting about a three-dimensional object.

4. A paving system as described in claim 2, wherein an inner portion thereof is configured to allow for fitting about a three dimensional object.

5. A paving system as described in claim 3, wherein said support frame is suspendable entirely about its peripheral vicinity portions when placed about a three-dimensional object.

6. A paving system as described in claim 4, wherein said support frame is suspendable entirely about its peripheral vicinity portions when placed about a three dimensional object.

7. A paving system as described in claim 3, wherein two substantially mirror image parts of said support frame are configured to be placed in opposition about a three-dimensional object so as substantially to enclose said object.

8. A paving system as described in claim 4, wherein two substantially mirror image parts of said support frame are configured to be placed in opposition about a three-dimensional object so as substantially to enclose said object.

9. A paving system as described in claim 5, wherein two substantially mirror image parts of said support frame are configured to be placed in opposition about a three-dimensional object so as substantially to enclose said object.

10. A paving system as described in claim 6, wherein two substantially mirror image parts of said support frame are configured to be placed in opposition about a three-dimensional object so as substantially to enclose said object.

* * * * *